US010847951B1

(12) United States Patent
Gozawa et al.

(10) Patent No.: US 10,847,951 B1
(45) Date of Patent: Nov. 24, 2020

(54) SPARK PLUG WITH A PLUG COVER FOR IMPROVING FUEL ECONOMY

(71) Applicant: NGK SPARK PLUG CO., LTD., Nagoya (JP)

(72) Inventors: Tatsuya Gozawa, Nagoya (JP); Daiki Goto, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/869,175

(22) Filed: May 7, 2020

(30) Foreign Application Priority Data

May 10, 2019 (JP) ..... 2019-089706

(51) Int. Cl.
*H01T 13/02* (2006.01)
*H01T 13/20* (2006.01)

(52) U.S. Cl.
CPC ..... *H01T 13/02* (2013.01); *H01T 13/20* (2013.01)

(58) Field of Classification Search
CPC ..... H01T 13/18; H01T 13/54
See application file for complete search history.

(56) References Cited

U.S. PATENT DOCUMENTS 6,013,973 A 1/2000 Sato
2020/0106246 A1* 4/2020 Gozawa ..... H01T 13/54

FOREIGN PATENT DOCUMENTS

JP 11-224763 A 8/1999

* cited by examiner

*Primary Examiner* — Joseph L Williams
(74) *Attorney, Agent, or Firm* — Leason Ellis LLP

(57) ABSTRACT

A spark plug includes: a center electrode; a ground electrode that is provided such that a gap for spark discharge is formed between the center electrode and the ground electrode; and a plug cover covering the center electrode and the ground electrode to form an auxiliary chamber. The plug cover is provided with plural through holes. A relationship of 80<A/B<5000 is satisfied, where a sphere has a center at a midpoint of a line connecting the center electrode and the ground electrode at a shortest distance on an axial line and contacts a point located closest from the center on each of inner open ends of the through holes. A $mm^3$ is a volume of a region of the auxiliary chamber, which is present in the sphere, and B $mm^2$ is an average area of the inner open ends of the through holes.

8 Claims, 4 Drawing Sheets

Fig.4

| | AUXILIARY CHAMBER IN-SPHERE VOLUME A ($mm^3$) | THROUGH HOLE | | A/B | COMBUSTION SPEED | IGNITABILITY | OVERALL EVALUATION |
|---|---|---|---|---|---|---|---|
| | | AVERAGE DIAMETER (mm) | AVERAGE AREA B ($mm^2$) | | | | |
| 1 | 962.7 | 1.0 | 0.79 | 1225.7 | 5 | 5 | 10 |
| 2 | 349.3 | 1.0 | 0.79 | 444.7 | 5 | 5 | 10 |
| 3 | 503.5 | 1.0 | 0.79 | 641.1 | 5 | 5 | 10 |
| 4 | 414.5 | 1.0 | 0.79 | 527.8 | 5 | 5 | 10 |
| 5 | 331.9 | 1.0 | 0.79 | 422.6 | 5 | 5 | 10 |
| 6 | 771.9 | 1.0 | 0.79 | 982.8 | 5 | 5 | 10 |
| 7 | 477.2 | 1.0 | 0.79 | 607.6 | 5 | 5 | 10 |
| 8 | 260.3 | 1.0 | 0.79 | 331.4 | 5 | 5 | 10 |
| 9 | 205.8 | 1.0 | 0.79 | 262.0 | 5 | 5 | 10 |
| 10 | 1023.3 | 1.0 | 0.79 | 1302.9 | 5 | 5 | 10 |
| 11 | 962.7 | 2.0 | 3.14 | 306.4 | 5 | 5 | 10 |
| 12 | 349.3 | 2.0 | 3.14 | 111.2 | 3 | 5 | 8 |
| 13 | 503.5 | 2.0 | 3.14 | 160.3 | 5 | 5 | 10 |
| 14 | 414.5 | 2.0 | 3.14 | 131.9 | 3 | 5 | 8 |
| 15 | 331.9 | 2.0 | 3.14 | 105.6 | 3 | 5 | 8 |
| 16 | 771.9 | 2.0 | 3.14 | 245.7 | 5 | 5 | 10 |
| 17 | 477.2 | 2.0 | 3.14 | 151.9 | 5 | 5 | 10 |
| 18 | 260.3 | 2.0 | 3.14 | 82.9 | 1 | 5 | 6 |
| 19 | 205.8 | 2.0 | 3.14 | 65.5 | 0 | 5 | 5 |
| 20 | 1023.3 | 2.0 | 3.14 | 325.7 | 5 | 5 | 10 |
| 21 | 962.7 | 0.5 | 0.20 | 4903.0 | 5 | 1 | 6 |
| 22 | 349.3 | 0.5 | 0.20 | 1779.0 | 5 | 3 | 8 |
| 23 | 503.5 | 0.5 | 0.20 | 2564.3 | 5 | 3 | 8 |
| 24 | 414.5 | 0.5 | 0.20 | 2111.0 | 5 | 3 | 8 |
| 25 | 331.9 | 0.5 | 0.20 | 1690.4 | 5 | 3 | 8 |
| 26 | 771.9 | 0.5 | 0.20 | 3931.3 | 5 | 3 | 8 |
| 27 | 477.2 | 0.5 | 0.20 | 2430.4 | 5 | 3 | 8 |
| 28 | 260.3 | 0.5 | 0.20 | 1325.7 | 5 | 5 | 10 |
| 29 | 205.8 | 0.5 | 0.20 | 1048.1 | 5 | 5 | 10 |
| 30 | 1023.3 | 0.5 | 0.20 | 5211.6 | - | 0 | 0 |

SPARK PLUG WITH A PLUG COVER FOR IMPROVING FUEL ECONOMY

This application claims the benefit of priority to Japanese Patent Application No. 2019-089706, filed May 10, 2019, which is incorporated herein by reference in its entirety.

FIELD OF THE INVENTION

The present invention relates to a spark plug.

BACKGROUND OF THE INVENTION

As an ignition spark plug used for an internal combustion engine, for example, a gasoline engine, a spark plug provided with an auxiliary chamber covering a center electrode and a ground electrode from the front side has been known (for example, Japanese Patent Application Laid-Open (kokai) No. H11-224763).

Normally, a spark plug having an auxiliary chamber causes spark discharge in a spark gap, which is for causing a spark and the gap between a center electrode and a ground electrode, and then flame is initially generated in the auxiliary chamber. Thereafter, the pressure in the auxiliary chamber is increased by the flame, and the flame jets out from the interior of the auxiliary chamber through a through hole to the outside of a plug cover due to the pressure. Then, fuel gas in a combustion chamber is burned using the flame having jetted out as an ignition source, whereby explosive combustion occurs in the combustion chamber.

Japanese Patent Application Laid-Open (kokai) No. H11-224763 discloses a spark plug in which a through hole of an auxiliary chamber is provided at the position of a spark gap in a direction along the axial line of the spark plug and a through hole is also provided at a position on the frontmost side of the auxiliary chamber.

Problems to be Solved by the Invention

However, in the spark plug described in Japanese Patent Application Laid-Open (kokai) No. H11-224763, after spark discharge, flame initially jets out from the through hole provided at the position of the spark gap, and then flame jets out from the through hole at the position on the frontmost side. Thus, in the spark plug of Japanese Patent Application Laid-Open (kokai) No. H11-224763, when the jetting speed of flame from the auxiliary chamber is excessively high, or when the opening area of each through hole is excessively small, misfire may occur due to heat loss. Thus, a technology that improves fuel economy and also inhibits misfire is desired.

SUMMARY OF THE INVENTION

Means for Solving the Problems

The present invention has been made to solve the above-described problem and can be embodied in the following modes.

(1) According to an aspect of the present invention, a spark plug is provided. The spark plug includes: a center electrode; a ground electrode that is provided such that a gap for spark discharge is formed between the center electrode and the ground electrode; and a plug cover covering the center electrode and the ground electrode from a front side of the spark plug to form an auxiliary chamber, the plug cover being provided with a plurality of through holes, wherein, a relationship of $80<A/B<5000$ is satisfied, where a sphere has a center at a midpoint of a line segment connecting the center electrode and the ground electrode at a shortest distance on an axial line of the center electrode and is in contact with a point located closest from the center on each of inner open ends of the plurality of through holes, and where A $mm^3$ is a volume of a region, of the auxiliary chamber, which is present in the sphere, and B $mm^2$ is an average area of the inner open ends of the plurality of through holes. In the spark plug of this aspect, by setting A/B to be within a desired range, the volume of the auxiliary chamber, the area of each through hole, and the amount of heat in the auxiliary chamber can be set to optimum conditions, and thus the jetting speed of flame is improved. As a result, fuel economy can be improved and misfire caused by heat dissipation to the plug cover can also be inhibited.

(2) In the spark plug of the above aspect, each of areas of the inner open ends of the plurality of through holes may be a value within ±5% with respect to the average area. In the spark plug of this aspect, the jetting speed of flame from each through hole becomes uniform, and thus combustion stability can be improved.

(3) In the spark plug of the above aspect, a relationship of $100<A/B<4000$ may be satisfied. In the spark plug of this aspect, fuel economy can be further improved and misfire can also be effectively inhibited.

(4) In the spark plug of the above aspect, a relationship of $150<A/B<1500$ may be satisfied. In the spark plug of this aspect, fuel economy can be further improved and misfire can also be effectively inhibited.

The present invention can be embodied in various forms, and can be embodied, for example, in forms such as an engine head on which a spark plug is mounted.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 4 is a diagram showing experimental results supporting the effect of improving fuel economy and also inhibiting misfire.

DETAILED DESCRIPTION OF THE INVENTION

A. First Embodiment

Figure 1:
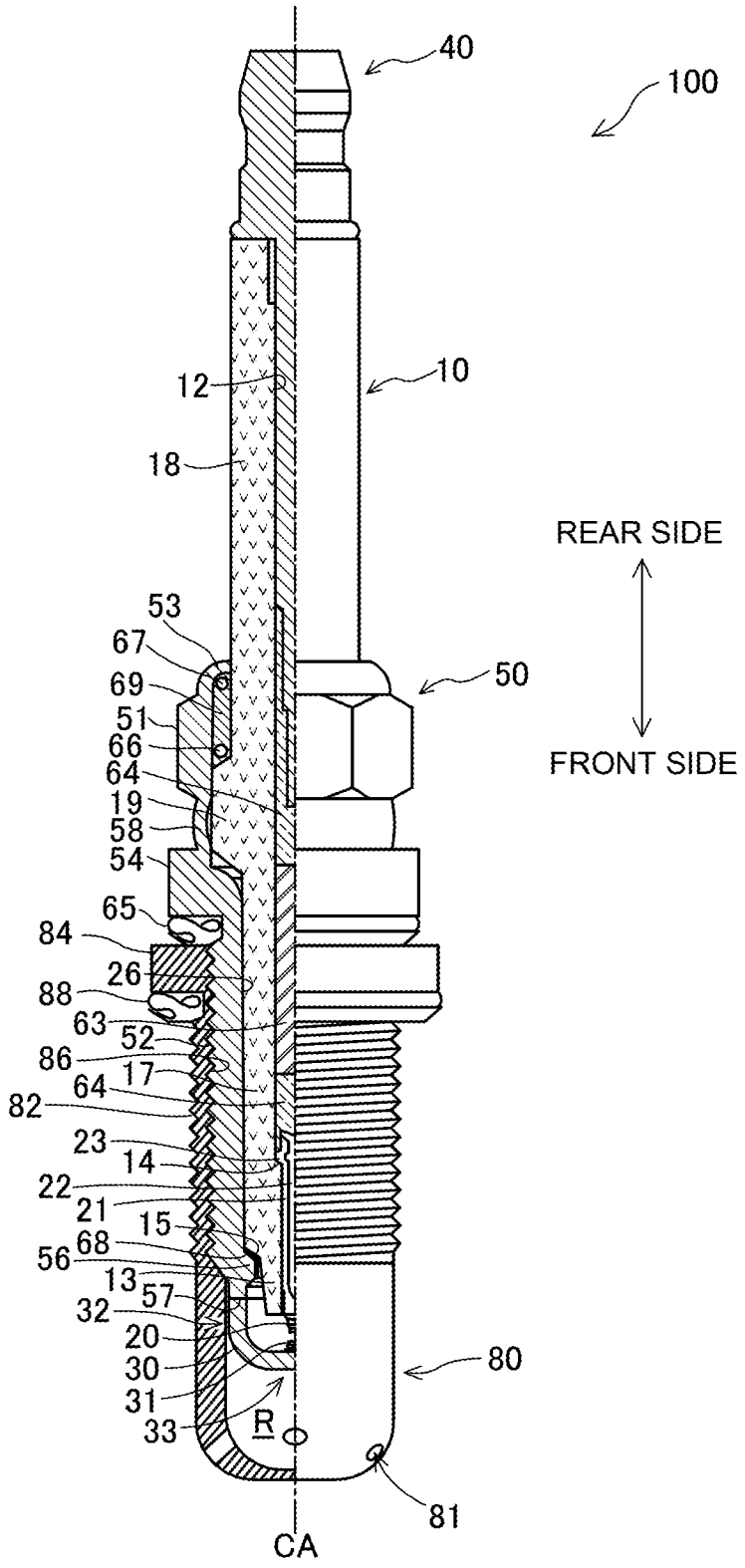
FIG. 1 is an explanatory diagram showing a partial cross section of a spark plug.

FIG. 1 is an explanatory diagram showing a partial cross section of a spark plug 100. In FIG. 1, with an axial line CA, which is the axis of the spark plug 100, as a boundary, the external appearance shape of the spark plug 100 is shown at the right side of the drawing sheet, and the cross-sectional shape of the spark plug 100 is shown at the left side of the drawing sheet. In the description of the present embodiment, the lower side of FIG. 1 is referred to as front side of the spark plug 100, and the upper side of FIG. 1 is referred to as rear side of the spark plug 100.

The spark plug 100 includes: an insulator 10 having an axial hole 12 along the axial line CA; a center electrode 20 provided in the axial hole 12; a tubular metal shell 50 disposed on the outer periphery of the insulator 10; a ground electrode 30 having a base end 32 fixed to the metal shell 50; and a plug cover 80 covering the center electrode 20 and the ground electrode 30. Here, the axial line CA of the spark plug 100 is the same as the axial line of the center electrode 20.

The insulator 10 is a ceramic insulator formed by firing a ceramic material such as alumina. The insulator 10 is a tubular member disposed on the inner periphery of the metal shell 50 and having the axial hole 12 that is formed at a center thereof and in which a part of the center electrode 20 is housed at the front side and a part of a metal terminal 40 is housed at the rear side. A central trunk portion 19 having a large outer diameter is formed at the center in the axial direction of the insulator 10. A rear trunk portion 18 having a smaller outer diameter than the central trunk portion 19 is formed at the rear side of the central trunk portion 19. A front trunk portion 17 having a smaller outer diameter than the rear trunk portion 18 is formed at the front side of the central trunk portion 19. A leg portion 13 having an outer diameter that decreases toward the center electrode 20 side is formed at the further front side of the front trunk portion 17.

The metal shell 50 is a cylindrical metal member that surrounds and holds a portion, of the insulator 10, extending from a part of the rear trunk portion 18 to the leg portion 13. The metal shell 50 is, for example, formed from low-carbon steel, and entirely plated with nickel, zinc, or the like. The metal shell 50 includes a tool engagement portion 51, a seal portion 54, and a mounting screw portion 52 in this order from the rear side. A tool for mounting the spark plug 100 to an engine head is fitted to the tool engagement portion 51. The mounting screw portion 52 is a portion that has an external thread formed on the outer periphery of the metal shell 50 over the entire circumference thereof and that is screwed into a screw groove 86 of the plug cover 80. The seal portion 54 is a portion formed in a flange shape at the root of the mounting screw portion 52. An annular gasket 65 formed by bending a plate is inserted and fitted between the seal portion 54 and a cover seal portion 84 of the plug cover 80. An end surface 57, at the front side, of the metal shell 50 has a hollow circular shape, and the front end of the leg portion 13 of the insulator 10 and the front end of the center electrode 20 project from the center of the end surface 57.

A crimp portion 53 having a small thickness is provided at the rear side with respect to the tool engagement portion 51 of the metal shell 50. In addition, a compressive deformation portion 58 having a small thickness similar to the crimp portion 53 is provided between the seal portion 54 and the tool engagement portion 51. Annular ring members 66 and 67 are interposed between the inner peripheral surface of the metal shell 50 and the outer peripheral surface of the rear trunk portion 18 of the insulator 10 from the tool engagement portion 51 to the crimp portion 53, and the space between these ring members 66 and 67 is further filled with powder of talc 69. During manufacturing of the spark plug 100, the compressive deformation portion 58 becomes compressively deformed by pressing the crimp portion 53 to the front side such that the crimp portion 53 is bent inward. Due to the compressive deformation of the compressive deformation portion 58, the insulator 10 is pressed within the metal shell 50 toward the front side via the ring members 66 and 67 and the talc 69. Due to the pressing, the talc 69 is compressed in the axial line CA direction, whereby the airtightness in the metal shell 50 is increased.

The metal shell 50 has a metal shell inner step portion 56 formed so as to project on the inner periphery of the metal shell 50. In addition, the insulator 10 has an insulator step portion 15 located at the rear end of the leg portion 13 and formed so as to project on the outer periphery of the insulator 10. On the inner periphery of the metal shell 50, the metal shell inner step portion 56 is in contact with the insulator step portion 15 via an annular packing 68. The packing 68 is a member for maintaining the airtightness between the metal shell 50 and the insulator 10, and prevents outflow of fuel gas. In the present embodiment, a plate packing is used as the packing.

The center electrode 20 is a rod-shaped member in which a core material 22 having better thermal conductivity than an electrode member 21 is embedded inside the electrode member 21. The electrode member 21 is formed from a nickel alloy containing nickel as a main component, and the core material 22 is formed from copper or an alloy containing copper as a main component. For example, a noble metal tip formed from an iridium alloy or the like may be joined to an end portion, at the front side, of the center electrode 20.

A flange portion 23 is formed near an end portion, at the rear side, of the center electrode 20 so as to project at the outer peripheral side of the center electrode 20. The flange portion 23 is in contact with an axial hole inner step portion 14, which projects at the inner peripheral side in the axial hole 12 of the insulator 10, from the rear side, and positions the center electrode 20 within the insulator 10. The center electrode 20 is electrically connected at the rear side thereof to the metal terminal 40 via a seal body 64 and a ceramic resistor 63.

The ground electrode 30 is formed from an alloy containing nickel as a main component. The base end 32 of the ground electrode 30 is fixed to the end surface 57 of the metal shell 50. The ground electrode 30 extends along the axial line CA from the base end 32 toward the front side, and is bent at an intermediate portion thereof such that one side surface of a front end portion 33 of the ground electrode 30 faces the front end surface of the center electrode 20. A noble metal tip 31 is provided on the surface, of the front end portion 33 of the ground electrode 30, which faces the center electrode 20 side. A gap for spark discharge is formed between the noble metal tip 31 of the ground electrode 30 and the center electrode 20. Hereinafter, this gap is also referred to as "spark gap". The noble metal tip 31 is formed from, for example, platinum, iridium, ruthenium, rhodium, or an alloy thereof.

The plug cover 80 is a member covering the center electrode 20 and the ground electrode 30 from the front side to form an auxiliary chamber R. The plug cover 80 of the present embodiment is formed from stainless steel. The auxiliary chamber R covers the spark gap. In the present embodiment, the auxiliary chamber R is a space surrounded by the insulator 10, the center electrode 20, the metal shell 50, the packing 68, and the plug cover 80. The screw groove 86 which is threadedly engaged with the mounting screw portion 52 of the metal shell 50 is formed on an inner wall of the plug cover 80, and the plug cover 80 is mounted to the metal shell 50 by screwing the metal shell 50 into the plug cover 80.

The plug cover 80 includes a screw portion 82 and the cover seal portion 84. The screw portion 82 is a portion that has an external thread formed on the outer periphery of the plug cover 80 over the entire circumference thereof and that is screwed into a screw groove of the engine head. The cover seal portion 84 is a portion formed in a flange shape at the root of the screw portion 82. An annular gasket 88 formed by bending a plate is inserted and fitted at the front side of the cover seal portion 84. The thickness of the plug cover 80 is not particularly limited, but may be, for example, about 1.5 mm to 3 mm.

The plug cover 80 is provided with a plurality of through holes 81 providing communication between the inside and the outside of the plug cover 80. By providing the through holes 81, fuel gas that is present in a combustion chamber of an engine can be caused to flow into the auxiliary chamber R, and flame generated in the auxiliary chamber R can be jetted to the outside of the plug cover 80.

In the spark plug 100 of the present embodiment, spark discharge is caused in the spark gap, and then flame is initially generated in the auxiliary chamber R. Thereafter, the pressure in the auxiliary chamber R is increased by the flame, and the flame jets out through the through holes 81 to the outside of the plug cover 80 due to this pressure. Then, fuel gas in the combustion chamber is burned using the flame having jetted out as an ignition source, whereby explosive combustion occurs in the combustion chamber.

Figure 2:
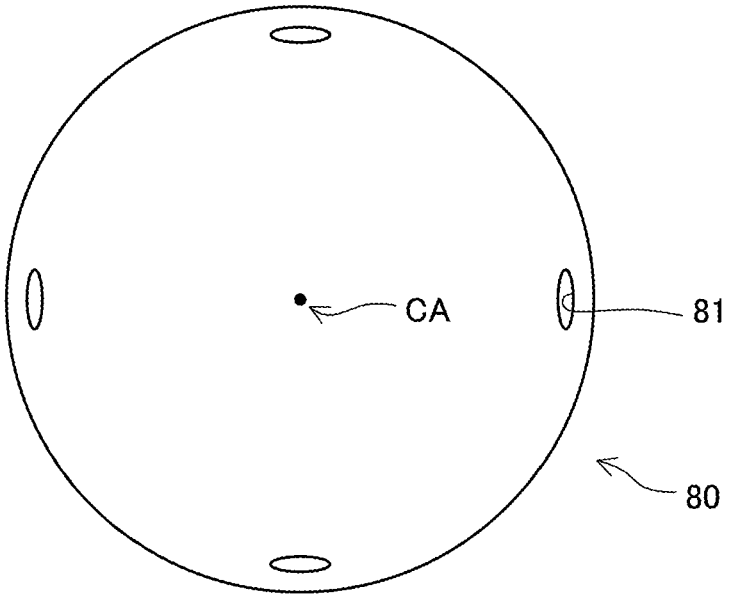
FIG. 2 is a schematic diagram of a plug cover as seen from a front side.

FIG. 2 is a schematic diagram of the plug cover 80 as seen from the front side. In the present embodiment, four through holes 81 are provided at equal intervals around the axial line CA. The number of through holes 81 is not limited thereto, and may be 3 or less or may be 5 or more. From the viewpoint of improvement in fuel economy, the number of through holes 81 is preferably equal to or greater than 2 and equal to or less than 8, and more preferably equal to or greater than 3 and equal to or less than 6.

Figure 3:
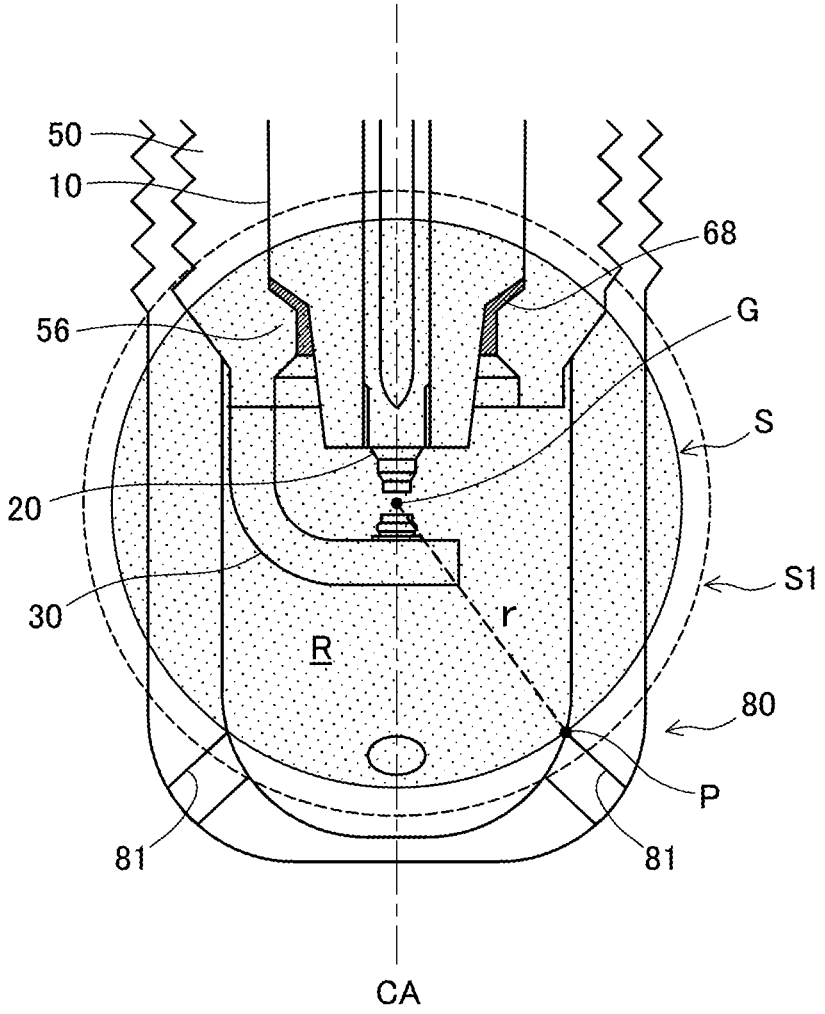
FIG. 3 is an enlarged view of an auxiliary chamber.

FIG. 3 is an enlarged view of the auxiliary chamber R. Here, a sphere S having a center G at a point that is the midpoint of a line segment connecting the center electrode 20 and the ground electrode 30 at the shortest distance on the axial line CA of the center electrode 20, is imagined. The sphere S is a sphere that is in contact with the point P, closest from the center G, on the inner open end of the through hole 81. That is, the radius r of the sphere S is a line segment from the center G to the point P. In the case where the spark plug 100 has a plurality of through holes 81, the points, closest from the center G, on the inner open ends of the plurality of through holes 81 are points P.

In the present embodiment, when the volume of a region, of the auxiliary chamber R, which is present in the sphere S is denoted by A $mm^3$, and the average area of the inner open ends of the plurality of through holes 81 is denoted by B $mm^2$, the relationship of $80<A/B<5000$ is satisfied.

In general, when the jetting speed of flame jetting out from each through hole 81 is excessively high, misfire is likely to occur due to heat loss. On the other hand, when the jetting speed of flame jetting out from each through hole 81 is excessively low, the combustion speed of fuel gas in the combustion chamber is decreased, and fuel economy tends to be deteriorated. Here, the jetting speed is greatly affected by the pressure in the auxiliary chamber R at the time of ignition and also greatly affected by the area of the inner open end of each through hole 81. The pressure in the auxiliary chamber R is greatly affected by the volume of the auxiliary chamber and the amount of heat in the auxiliary chamber.

In the spark plug 100 of the present embodiment, by setting the volume of the auxiliary chamber R, the area of each through hole 81, and the amount of heat in the auxiliary chamber R to optimal conditions, fuel economy can be improved and misfire can also be inhibited.

That is, in the spark plug 100 of the present embodiment, by setting A/B to be greater than 80, a decrease in the jetting speed of flame can be inhibited. As a result, flame spreads throughout the combustion chamber, a decrease in the combustion speed of fuel gas is inhibited, and fuel economy is improved. From the viewpoint of improvement in fuel economy, A/B is preferably greater than 100 and further preferably greater than 150.

Moreover, in the spark plug 100 of the present embodiment, by setting A/B to be less than 5000, occurrence of misfire caused by heat dissipation to a side wall of the plug cover 80 due to reduction in the sizes of the through holes 81 can be inhibited. From the viewpoint of inhibiting misfire, A/B is more preferably less than 4000 and further preferably less than 1500.

The volume A is not particularly limited, but, from the viewpoint of setting the jetting speed of flame to be in a preferable range, the volume A is preferably equal to or greater than 200 $mm^3$ and equal to or less than 1500 $mm^3$, and more preferably equal to or greater than 300 $mm^3$ and equal to or less than 1000 $mm^3$.

The average area B is not particularly limited, but, from the viewpoint of inhibiting a decrease in the jetting speed of flame and also inhibiting misfire, the average area B is preferably equal to or greater than 0.20 $mm^2$ and equal to or less than 5.00 $mm^2$, and more preferably equal to or greater than 0.30 $mm^2$ and equal to or less than 3.00 $mm^2$.

Here, the volume of the auxiliary chamber R means the volume of the space surrounded by the insulator 10, the center electrode 20, the metal shell 50, the packing 68, and the plug cover 80. The volume of the auxiliary chamber R does not include the volumes of the through holes 81. The volume of the auxiliary chamber R can be calculated from a 3D image of the auxiliary chamber R obtained by scanning the interior of the auxiliary chamber R using an X-ray CT scanner under the conditions of a maximum tube voltage of 200 kV and a maximum tube current of 120 μA. In addition, the volume of the sphere S can be calculated by calculating the radius r of the sphere S from this 3D image. Similarly, the average area of the inner open ends of the plurality of through holes 81 can be calculated from this 3D image. The area of the inner open end of each through hole 81 is calculated for a flat surface, not a curved surface.

In the spark plug 100 of the present embodiment, the volume of the auxiliary chamber R is 450 $mm^3$, the volume of the sphere S is 1276 $mm^3$, the volume A of the region, of the auxiliary chamber R, which is present in the sphere S is 415 $mm^3$, and the average area B of the inner open ends of the plurality of through holes 81 is 0.79 $mm^2$. Thus, in the spark plug 100 of the present embodiment, A/B is 525.

In the spark plug 100 according to the present embodiment, the metal shell inner step portion 56 is present in the sphere S. In the spark plug 100 of this embodiment, since the volume of the auxiliary chamber R at the rear side with respect to the center G is decreased, the pressure in the auxiliary chamber R at the time of ignition is further increased, and thus a combustion speed is increased. The metal shell inner step portion 56 does not have to be present in the sphere S.

Moreover, in the spark plug 100 according to the present embodiment, the packing 68 is present in the sphere S. In the spark plug 100 of this embodiment, since the volume of the auxiliary chamber R at the rear side with respect to the center G is decreased, the pressure generated at the time of ignition can be efficiently propagated to the through holes 81. The packing 68 does not have to be present in the sphere S.

Moreover, in the spark plug 100 according to the present embodiment, the point, closest from the center G, on each of the inner open ends of the plurality of through holes 81 is present in an imaginary sphere S1 obtained by multiplying the radius r of the sphere S by 1.1. In general, flame propagates substantially concentrically from the ignition point. In the spark plug 100 of this embodiment, the flame generated at the time of ignition propagates substantially equally to each through hole 81. As a result, the length of flame jetting out from each through hole 81 can be made substantially equal, and thus uneven distribution of a combustion region of fuel gas in the combustion chamber can be inhibited. The point, closest from the center G, on each of the inner open ends of the plurality of through holes 81 does not have to be included in the imaginary sphere S2.

Moreover, in the spark plug 100 according to the present embodiment, a part of a side wall of the plug cover 80 is present in the sphere S. In the spark plug 100 of this embodiment, when the pressure generated at the time of ignition propagates to the through holes 81, the pressure also reaches the side wall present in the sphere S, and thus the pressure in the auxiliary chamber R is increased. As a result, the length of flame jetting out from the through holes 81 can be increased. Thus, the combustion speed of fuel gas in the combustion chamber can be increased, so that fuel economy is improved.

Moreover, in the spark plug 100 according to the present embodiment, each of the areas of the inner open ends of the plurality of through holes 81 is a value within ±5% with respect to the average area B. By setting as such, the jetting speed of flame from each through hole 81 becomes uniform, and thus combustion stability can be improved. From the viewpoint of improving combustion stability, each of the areas of the inner open ends of the plurality of through holes 81 is preferably a value within ±3% with respect to the average area B. The area of the inner open end of each through hole 81 does not have to be within ±5% with respect to the average area B.

FIG. 4 is a diagram showing experimental results supporting the effect of improving fuel economy and also inhibiting misfire. In this experiment, as shown in FIG. 4, samples of spark plugs in which the volume A and the average area B were made different for each sample were produced. In this experiment, for easy understanding, the shape of each inner open end is a circle, and the diameter thereof is also described in FIG. 4, but the shape of each inner open end is not limited to a circle.

In this experiment, evaluation for combustion speed and misfire rate was made. Specifically, a sample was mounted to an in-line 4-cylinder direct-injection turbo engine having a displacement of 1.6 L, and a combustion speed and a misfire rate were measured under the conditions of a net mean effective pressure (NMEP) of 1000 kPa and an engine speed of 2000 rpm.

The combustion speed was evaluated by a score using the ratio by which a combustion speed (calculated from a time required for MFB (mass fraction burn (MFB) to reach 90% by mass from 10% by mass) was increased as compared to a commercial spark plug. Specifically, the combustion speed was evaluated as follows. A higher score indicates that the combustion speed is higher and also indicates that fuel economy is better.

20% or more: 5 points

10% or more and less than 20%: 3 points

5% or more and less than 10%: 1 point

Less than 5%: 0 points

As the misfire rate, a misfire rate when operating 1000 cycles was used, and the misfire rate was evaluated by a score. Specifically, the combustion speed was evaluated as follows. A higher score indicates that the misfire rate is lower.

Misfire rate is less than 1%: 5 points

Misfire rate is equal to or greater than 1% and less than 3%: 3 points

Misfire rate is equal to or greater than 3% and less than 7%: 1 point

Misfire rate is equal to or greater than 7%: 0 points

Moreover, as overall evaluation, the sum of the score for combustion speed and the score for misfire rate was calculated.

From the experimental results shown in FIG. 4, the following was found. Specifically, by comparing the experimental results of sample 19 to those of the other samples, it was found that the combustion speed is increased when A/B is greater than 80. In addition, from these experimental results, it was found that the combustion speed tends to be increased when A/B increases. Meanwhile, by comparing the experimental results of sample 30 to those of the other samples, it was found that the misfire rate is reduced when A/B is less than 5000. Moreover, from these experimental results, it was found that the misfire rate tends to be reduced when A/B decreases. For sample 30, data of the combustion speed was not stable since the misfire rate was excessively high, and thus "-" is shown at the item for combustion speed.

B. Other Embodiments

The present invention is not limited to the above-described embodiment and can be embodied in various configurations without departing from the gist of the present invention. For example, the technical features in the embodiment corresponding to the technical features in each aspect described in the Summary of the Invention section can be appropriately replaced or combined to solve part or all of the foregoing problems, or to achieve part or all of the foregoing effects. Further, such technical features can be appropriately deleted if not described as being essential in the present specification.

In the above-described embodiment, the metal shell 50 and the plug cover 80 are separate members, but are not limited thereto and may be integrated with each other. In addition, the ground electrode 30 is provided to the metal shell 50, but is not limited thereto and may be provided, for example, to the plug cover 80.

DESCRIPTION OF REFERENCE NUMERALS

10: insulator
12: axial hole
13: leg portion
14: axial hole inner step portion
15: insulator step portion
17: front trunk portion
18: rear trunk portion
19: central trunk portion
20: center electrode
21: electrode member
22: core material
23: flange portion
30: ground electrode
31: noble metal tip
32: base end
33: front end portion
40: metal terminal
50: metal shell
51: tool engagement portion
52: mounting screw portion
53: crimp portion

54: seal portion
56: metal shell inner step portion
57: end surface
58: compressive deformation portion
63: ceramic resistor
64: seal body
65: gasket
66, 67: ring member
68: packing
69: talc
80: plug cover
81: through hole
82: screw portion
84: cover seal portion
86: screw groove
88: gasket
100: spark plug
A: volume
B: average area
CA: axial line
G: center
R: auxiliary chamber
S: sphere
S1: imaginary sphere
r: radius

The invention claimed is:

1. A spark plug comprising:

a center electrode;

a ground electrode is provided such that a gap for spark discharge is formed between the center electrode and the ground electrode; and a plug cover covering the center electrode and the ground electrode from a front side of the spark plug to form an auxiliary chamber, the plug cover being provided with a plurality of through holes, wherein a relationship of $80<A/B<5000$ is satisfied, where a sphere has a center at a midpoint of a line segment connecting the center electrode and the ground electrode at a shortest distance on an axial line of the center electrode and is in contact with a point located closest from the center on each of inner open ends of the plurality of through holes, and where A $mm^3$ is a volume of a region of the auxiliary chamber, which is present in the sphere, and B $mm^2$ is an average area of the inner open ends of the plurality of through holes.

2. The spark plug according to claim 1, wherein each of areas of the inner open ends of the plurality of through holes is a value within ±5% with respect to the average area.

3. The spark plug according to claim 1, wherein a relationship of $100<A/B<4000$ is satisfied.

4. The spark plug according to claim 1, wherein a relationship of $150<A/B<1500$ is satisfied.

5. The spark plug according to claim 2, wherein a relationship of $100<A/B<4000$ is satisfied.

6. The spark plug according to claim 2, wherein a relationship of $150<A/B<1500$ is satisfied.

7. The spark plug according to claim 3, wherein a relationship of $150<A/B<1500$ is satisfied.

8. The spark plug according to claim 5, wherein a relationship of $150<A/B<1500$ is satisfied.

* * * * *